US007060889B2

(12) United States Patent
Bellak

(10) Patent No.: US 7,060,889 B2
(45) Date of Patent: Jun. 13, 2006

(54) STRAP AMPLIFIER

(76) Inventor: Peter Roy Bellak, 27 Alhambra Cir., Fairfax, CA (US) 94903

( * ) Notice: Subject to any disclaimer, the term of this patent is extended or adjusted under 35 U.S.C. 154(b) by 103 days.

(21) Appl. No.: 10/884,455

(22) Filed: Jul. 1, 2004

(65) Prior Publication Data

US 2006/0000346 A1 Jan. 5, 2006

(51) Int. Cl.
*G10H 1/46* (2006.01)
*G10H 3/12* (2006.01)

(52) U.S. Cl. ..... 84/741; 84/327; 381/118

(58) Field of Classification Search ..... 84/327–329
See application file for complete search history.

(56) References Cited

U.S. PATENT DOCUMENTS 5,633,474 A * 5/1997 Cardey, III ..... 84/663
6,031,166 A * 2/2000 Petrarca ..... 84/327
6,137,675 A * 10/2000 Perkins ..... 361/679
2001/0035084 A1* 11/2001 Kulas ..... 84/290

* cited by examiner

*Primary Examiner*—Jeffrey W Donels
(74) *Attorney, Agent, or Firm*—Risto A. Rinne, Jr.

(57) ABSTRACT

An apparatus for amplifying the sound of a stringed instrument includes, in its most basic form, a speaker attached to a strap that is adapted to be draped around a musician with each end thereof detachably-attachable to the stringed instrument. An amplifier circuit, according to a first embodiment, is connected to the speaker and attached to the strap along with a battery. A pickup wire is attached to an input of the amplifier circuit and to an electrical jack on the musical instrument. Portable amplification of the stringed instrument is provided. Other embodiments disclose a remote amplifier circuit and a remote battery that are attached elsewhere to the musician while the amplifier circuit output remains connected to the speaker that is always attached to the strap. A two-piece strap is disclosed as are a variety of different types of speakers that are attached to any preferred version of the strap.

13 Claims, 4 Drawing Sheets

APPENDIX A
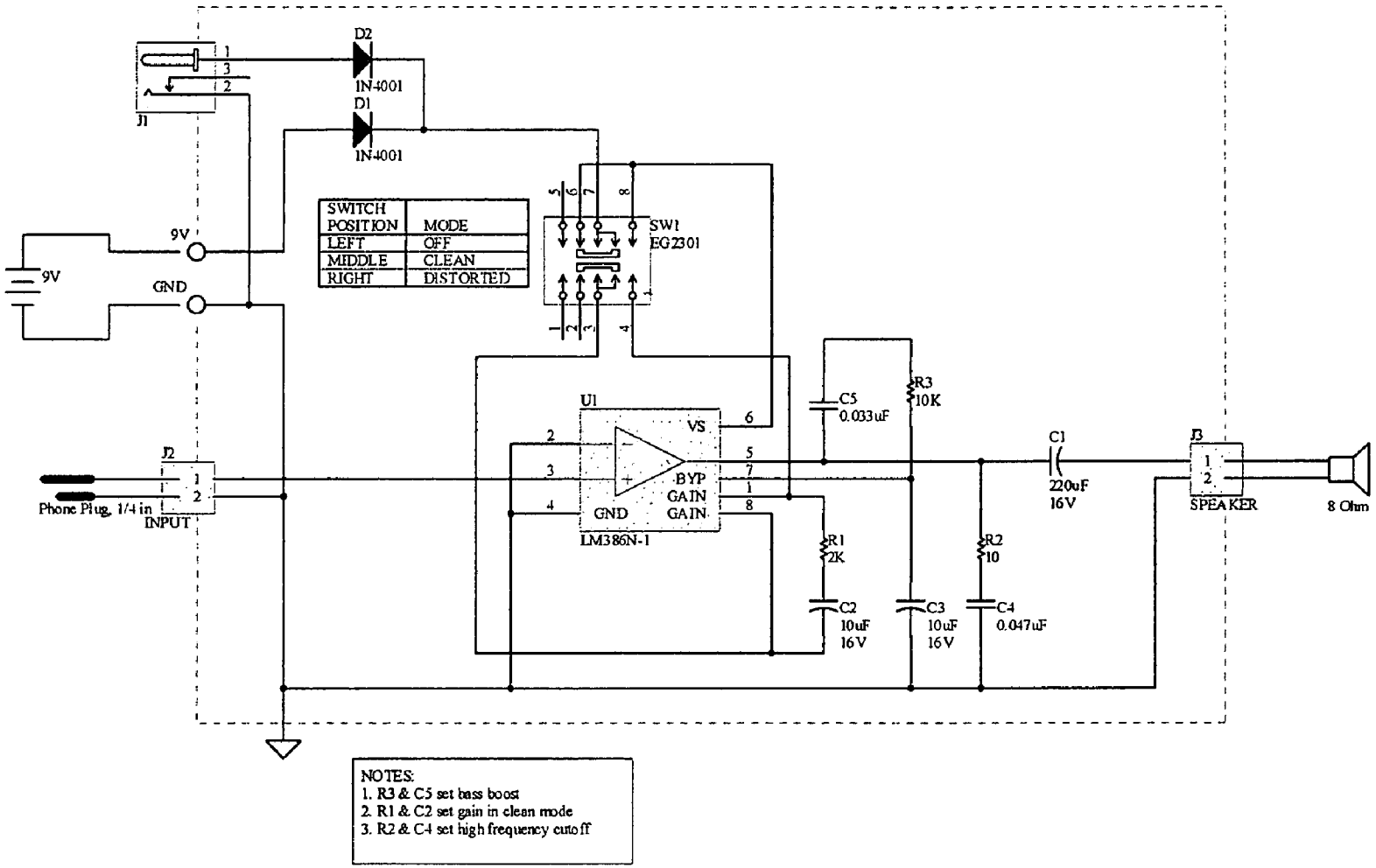

STRAP AMPLIFIER

BACKGROUND OF THE INVENTION

1. Field of the Invention

The present invention, in general, relates to amplifiers for musical instruments and, more particularly, to a strap for holding a guitar or other type of stringed musical instrument that either includes or is adapted to include an electrical pickup.

There are many types of guitars, banjos, ukuleles, mandolins and other stringed instruments. Virtually all of these include a pair of pins, commonly referred to as "buttons" that are adapted to enter into a pair of slots on opposite sides of a support strap. This is sometimes referred to as a "two-pin strap mounting system." The strap then drapes over the shoulder of the user and helps support the instrument at the proper position for playing.

Many of these stringed instruments include an electrical/electronic/magnetic pickup. The pickup is essentially a type of a transducer (i.e., a microphone) that converts the acoustical vibrations emanating from the musical instrument into an electrical waveform that is representative of the sound produced. The electrical waveform is sent to an amplifier which, in turn, amplifies the electrical waveform to a greater magnitude (i.e., voltage). The amplified waveform is then supplied to speakers which reproduce the sound.

This type of amplification is done in "real time", therefore making the musical instrument sound louder. When a person or a band plays various instruments on a stage (i.e., during a performance), this is typically the manner by which a sufficient volume level is maintained so that all who are present can hear. Typically, a plurality of speakers are placed on the stage and are directed toward the listening public. In short, the musical instruments sound louder than they would normally be because the sound of the instruments are electrically amplified and the amplified sound is output through the speakers.

The use of an acoustical pickup and amplification system allows for another important benefit and that is being able to adjust the output level of each musical instrument to the desired degree to harmonize with the other musical instruments. This is especially important because certain musical instruments are naturally louder than others.

If it were not for an amplification system that can boost the sound pressure (i.e., the volume) of less powerful instruments while lessening the volume of more powerful instruments, the louder instruments would always tend to drown out the softer, quieter instruments. By varying the sound levels the musicians are able to highlight the performance of any instrument(s) while minimizing the performance of others. This provides a degree of artistic expression that is not limited by the sound output of any musical instrument. Controlling the volume of any instrument relative to another is known as "volume dynamics".

However, such an amplification type of system requires a good deal of setup and expensive equipment that must be transported, carried in, and then set up. The set-up takes time and is expensive if done by others. Also, these systems are complicated with numerous wires that abound on the stage. The wires on the stage pose a risk that the performers must avoid else they may become entangled with them possibly tripping or disconnecting certain instruments from the source of amplification as the performers move about on stage.

There are times when such an elaborate amplification system is not required. When a stringed instrument is playing alone in a smaller area or in concert with perhaps only a few other instruments, such as a violin and/or an accordion (or with numerous other limited combinations), a small amount of sound amplification is all that is required to elevate the sound of the stringed instrument sufficient to blend and be properly heard.

To satisfy this need a small battery powered amplifier has been available that is sold under the tradename "Smokey Joe." It includes a small container the size of a pack of cigarettes for insertion into a shirt pocket along with an input jack, a small amplifier circuit, a small battery, and small speaker, all of which are contained in the container. Alternately, the Smokey Joe is inserted in a pocket elsewhere, for example, a pocket that is attached to a guitar strap. However, there are many disadvantages to this device.

First, an electrical cord must be supplied and connected to the electrical jack (i.e., pickup) at the instrument at one end and to the prior art device at the other end. The cord, therefore, dangles and can become ensnared.

Also, the speaker's output is muffled by the cloth material of the pocket that it is placed in, thereby distorting the sound and reducing its output accordingly.

Lastly, there is no way to even modify such a device to amplify bass frequencies. Bass requires a larger speaker capable of producing bass notes. Such a speaker could never fit into the prior device's small pocket-sized container. If the container were made larger, then the container could not fit into the pocket, as intended.

Additionally, the battery in the prior art device is limited. It cannot supply enough power for bass nor can it last for a lengthy concert or other type of extended duration performance.

Also, most stringed instruments that include an electrical pickup also include a volume control. It is desirable for an amplifier circuit to produce a fixed amount of amplification for a known amplitude input wherein a musician can control the final sound output (i.e., volume) from a speaker by varying the volume control that, in turn, varies the amplitude of the input waveform and subsequently, the amplitude of the amplified waveform.

Finally, it is desirable for the musician to also hear the speaker's output during a performance. This is useful for a variety of reasons, including allowing the musician to stay in harmony and verify that his instrument is producing the intended level of sound output.

Also, while it is desirable to be able to turn such a system on or off, there is also a need for such an amplifier to include a maximum gain position in which the amplifier circuit is overdriven so as to "clip" the amplified waveform and produce the various harmonics associated with clipping. These harmonics are commonly referred to in the performing musical arts industry as "distortion". Distortion is sometimes preferred and a way to produce it without elaborate stage amplification equipment is desirable.

Accordingly, there exists today a need for an amplifier strap that helps to ameliorate the above-mentioned difficulties by including a speaker and optional amplifier circuit attached to an amplifier strap.

Clearly, such an apparatus would be useful and desirable.

2. Description of Prior Art

A related prior art device is known that is sold under the tradename "Smokey Joe." A guitar strap adapted to receive the Smokey Joe is available at the website, www.smokeyamps.com. Prior art U.S. Pat. No. 6,441,294 to Seli that issued Aug. 27, 2002 discloses a Tug-a-Wah device that is disposed intermediate an electric guitar and amplifier circuit that responds to neck movements of the guitar to affect the waveform.

While the structural arrangements of the above-described device may, at first appearance, have similarities with the present invention, it differs in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide an amplifier strap that includes a speaker permanently attached thereto.

It is also an important object of the invention to provide an amplifier strap that is adapted for use with a stringed instrument that includes an electrical pickup.

Another object of the invention is to provide an amplifier strap that includes a speaker permanently attached thereto that is used to support a stringed instrument.

Still another object of the invention is to provide an amplifier strap that includes an amplifier circuit that is attached to a strap used to support a stringed instrument.

Still yet another object of the invention is to provide an amplifier strap that includes a speaker and an amplifier circuit that are attached to a strap used to support a stringed instrument.

Yet another important object of the invention is to provide an amplifier strap that includes a source of power that is attached to a strap used to support a stringed instrument.

Another important object of the invention is to provide an amplifier strap that includes an electrical plug and wire that is easily manageable and does not dangle.

A first continuing object of the invention is to provide an amplifier strap that helps to hide a wire that is connected at one end thereof to a stringed instrument and to an amplifier circuit at an opposite end.

A second continuing object of the invention is to provide an amplifier strap that includes a self-contained amplifier circuit, connections, and speaker.

A third continuing object of the invention is to provide an amplifier strap that includes a self-contained amplifier circuit, connections, and a speaker that can produce bass.

A fourth continuing object of the invention is to provide an amplifier strap that includes a self-contained amplifier circuit, connections, and a speaker that can produce bass for an extended period of time at a higher volume than previously attainable.

A fifth continuing object of the invention is to provide an amplifier strap that includes a self-contained amplifier circuit, connections, and a speaker that can produce sound for an extended length performance.

A sixth continuing object of the invention is to provide an amplifier strap that includes a self-contained amplifier circuit, connections, and a speaker attached to the strap and a battery pack that is worn elsewhere by the musician.

A seventh continuing object of the invention is to provide an amplifier strap that includes a self-contained amplifier circuit, connections, and a speaker attached to the strap that eliminates wires on the floor.

An eighth continuing object of the invention is to provide an amplifier strap that includes a self-contained amplifier circuit, connections, and a speaker attached to the strap that is attractive and unobtrusive.

A ninth continuing object of the invention is to provide an amplifier strap that includes a self-contained amplifier circuit, connections, and a speaker attached to the strap wherein the speaker can be as large as desired.

A tenth continuing object of the invention is to provide an amplifier strap that includes a self-contained amplifier circuit, connections, and a speaker attached to the strap wherein the speaker is disposed close enough to an ear of a musician so that the musician can hear the speaker's output.

An eleventh continuing object of the invention is to provide an amplifier strap that includes a self-contained amplifier circuit, connections, and a speaker attached to the strap that is adapted for use with a stringed instrument having an electrical pickup and a volume control knob on the instrument.

A twelfth continuing object of the invention is to provide an amplifier strap that includes a three-position switch, with an on position, an off position, and a maximum gain (distortion) position.

Briefly, an amplifier strap that is constructed in accordance with the principles of the present invention always has a speaker permanently attached to a strap that is used to support a stringed musical instrument. An amplifier circuit is also preferably attached to the strap. A battery is either supported by the strap or is attached elsewhere to an article of clothing worn by a musician, for example, to a belt. The speaker's output is directed away from the musician. A pickup wire is attached to a jack at the instrument at a first end and to the amplifier circuit at an opposite second end. A pair of power supply wires connect the battery to the amplifier circuit and a pair of speaker wires connect the amplifier circuit to the speaker. A three-position switch is used to turn the amplifier circuitry on, shut it off, or to overdrive (i.e., clip and distort the amplified waveform) the amplifier circuitry.

Figure 1:
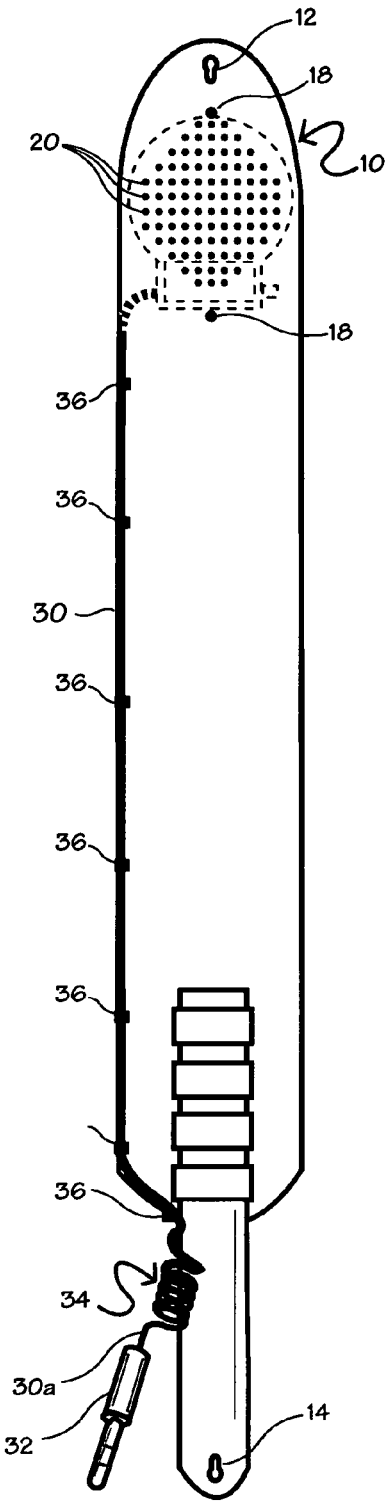
FIG. 1 is a front plan view of an amplifier strap.

APPENDIX A is a schematic of a preferred amplifier circuit for use with the amplifier strap of FIG. 1.

DETAILED DESCRIPTION OF THE INVENTION

Figure 2:
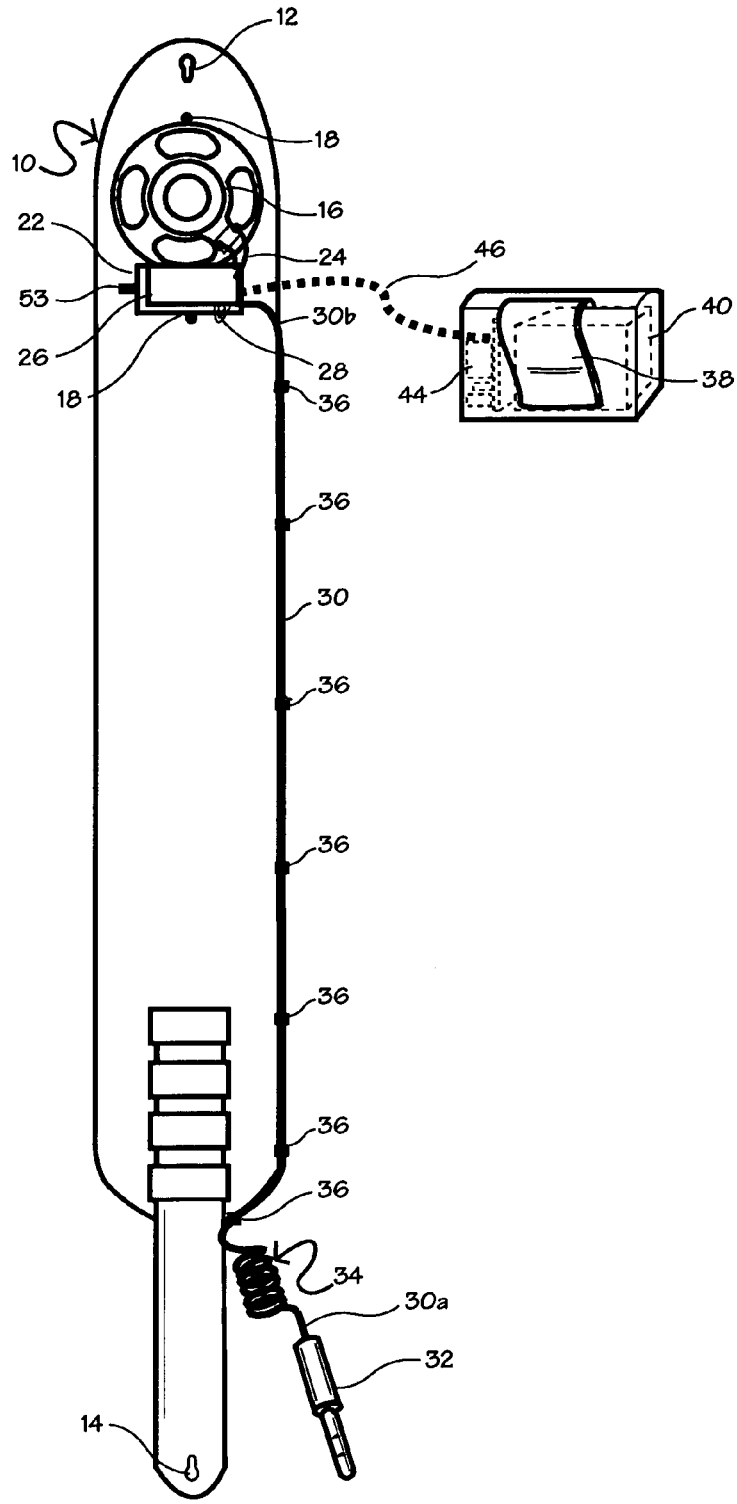
FIG. 2 is a rear plan view of the amplifier strap of FIG. 1.

Referring to all of the drawing figures and in particular now both to FIG. 1 and FIG. 2 is shown an amplifier strap, identified in general by the reference numeral 10.

The strap 10 is made of any desired material, for example, leather, nylon, fabric, etc.

The strap 10 includes an upper keyhole slot 12 and a lower keyhole slot 14 for attachment of the strap 10 to a stringed musical instrument (not shown), for example, a guitar.

Pins (not shown) on the musical instrument cooperate with the upper and lower keyhole slots 12, 14 to secure each end of the strap 10 to an appropriate location on the instrument. This is well-known in the musical arts where the pins, as mentioned hereinabove, are often referred to as "buttons" because each pin includes an enlarged head that the keyhole slots 12, 14 retain, similar to the way in which a slot (not shown) that is provided in a pair of pants (not shown) secures a conventional type of a button (not shown).

A speaker 16 is attached proximate an upper end of the strap 10. The attachment near the upper end is important because it ensures that sound output from the speaker 16 will not be blocked by the instrument itself.

It also places the speaker 16 proximate a head (not shown) of a musician, thereby enabling the musician to simultaneously hear the musical instrument's natural (i.e., not amplified) output, the output of other instruments that may be playing, and the speaker's output (i.e., the musical instrument's amplified output) while playing.

This allows the musician to adjust the gain (i.e., to vary a potentiometer commonly found on the musical instrument) which, in turn, adjusts the output volume of the speaker 16 to a desired level.

The speaker 16 is attached by rivets 18 or any other preferred method of permanently securing the speaker 16 to the strap 10. If desired, an end of the speaker 16 can be loosened for access as needed for cleaning, etc.; however, the speaker 16 is designed to remain with the strap 10.

Numerous benefits are attained when the speaker 16 is permanently attached to the strap 10, for example, the strap is optimized so as to not muffle the speaker's output, as is described in greater detail hereinafter. Also, the direction the speaker 16 faces so that the listening public can optimally hear it, the ability of the musician to simultaneously hear its output, and other benefits are provided as are described in greater detail hereinafter.

The speaker 16 is located on the inside of the strap 10, adjacent to the musician's body. In this way, the speaker's 16 output is directed away from the musician.

A plurality of holes 20 are provided in the strap 10 which act as a protective layer over the speaker 16 that allows the undistorted sound to emanate from the strap 10. The holes 20 do not mute or muffle the sound output any more than does a covering over a conventional type of a loudspeaker (not shown). The size, quantity, and position of the plurality of holes 20 are matched to the speaker 16, and therefore optimize the sound that is produced.

It is important to note that the speaker's 16 output radiates directly in a straight line away from the amplifier strap 10 and toward a listening audience (not shown). There is no cloth or other material disposed over the speaker 16 that could otherwise diminish or degrade the clarity or the level of its output, such as would occur if a prior art type of a pocket (not shown) were used.

The holes 20 are punched or otherwise formed in the strap 10 and include a size and shape that optimizes sound transmission. The holes 20 can include any size or shape of an opening in any quantity or density, as desired.

An amplifier circuit 22 is attached to the strap 10 proximate the speaker 16. A pair of speaker wires 24 connect the output of the amplifier circuit 22 to the speaker's 16 input.

A replaceable or rechargeable battery 26 is attached to the strap 10 proximate the amplifier circuit 22. A pair of power supply wires 28 connect the battery 26 to the amplifier circuit 22.

A pickup wire 30 includes a first end 30*a* that is attached to a ¼ inch male connector plug 32. The connector 32 fits into a standard ¼ inch female socket (not shown) that is of the type commonly used on the instrument. The socket is commonly referred to as a "jack" in the musical arts.

A section of coiled cord, identified in general by the reference numeral 34, is preferably included with the pickup wire 30 proximate the connector 32. The coiled cord 34 allows for controlled expansion as required for the connector 32 to mate with the socket without excessive slack or draping of the pickup wire 30.

The pickup wire 30 includes an opposite second end 30*b* that is electrically attached to the amplifier circuit 22.

A plurality of ties 36 secure the pickup wire 30 to the back of the strap 10 while directing the pickup wire 30 so that the first end 30*a* is disposed proximate a bottom of the strap 10.

The pickup wire 30, when fully extended, forms an electrical cord that is approximately seven feet in overall length.

This type of an electrical amplifier circuit 22 is not new, and, therefore, the circuitry is not described in detail, it being well-known in the electrical audio amplification art to those possessing ordinary skill in such art. A preferred type of the amplifier circuit 22 is shown in APPENDIX A. The amplifier circuit 22 is selected from any conventional design, as is well known in the art.

In use, the musician drapes the strap 10 around the back and over his or her shoulder with the end proximate the speaker 16 on top. The keyhole slots 12, 14 of the strap 10 are fastened to the pins (i.e., buttons) of the instrument. The connector 32 is plugged into the socket of the instrument, and a three-position switch 53 is urged from a first "off" position into a second "on" position, after which the musician plays the instrument. The amplifier circuit 22 receives an electrical input through the pickup wire 30 from the instrument, amplifies it, and uses the amplified waveform to drive the speaker 16.

Accordingly, amplification of the instrument is provided without any cords on the floor for the musician to trip or become entangled with. There are no amplifiers or power sources that are disposed external (i.e., away from) the musician. The system is entirely portable. When the musician is done performing, the switch 53 is turned "off" and the connector 32 is pulled from the jack (i.e., socket). Amplification ceases and battery 26 life is optimally prolonged. Set-up and take-down is accomplished by turning the switch 53 on or off, respectively, and by plugging the connector 32 in the socket or removing it from the socket, thereby providing virtually instant set-up where desired. It is even possible to leave the connector 32 attached to the jack (socket) and simply turn the switch 53 on or off, as desired.

If the musical instrument has a gain control (i.e., a potentiometer), the musician adjusts it which, in turn, adjusts the input into the amplifier circuit 22. When the switch 53 is in the second "on" position, the amplifier circuit 22 provides a constant gain (i.e., degree of electrical amplification) in a normal operating range. Therefore, when the musical instrument's gain control is adjusted, the input to the amplifier circuit 22 is increased or decreased accordingly, and the sound volume emanating from the speaker 16 is similarly increased or decreased to suit.

The user is able to adjust the volume output level when the switch 53 is in the second "on" position so that a substantially undistorted (all amplifier circuits 22 introduce at least some distortion to a waveform) sound is heard from the speaker 16. The second "on" position may be labeled as "on" or "clear tone" or "normal" (or otherwise) to indicate that a pure, undistorted sound is being produced.

If desired, a more sophisticated amplifier circuit 22 is provided with gain control attached thereto.

However, it is common practice to overdrive a sound amplification system during live performances (and even to capture this on recording media). When the amplifier circuit 22 is overdriven, the waveform "clips", which means that a sufficiently high output voltage for the waveform cannot be produced, thereby it "clips" at its maximum volume for portions of the musical performance. Various harmonics are also produced and the resultant sound is said to include "distortion". Distortion is associated with live musical performances and is surprisingly common and desirable, for it adds a unique sound.

The switch 53 includes a third position, "distortion" in which a greater amount of gain (amplification) is introduced by the amplifier circuit 22 than when the switch 53 is in the second on position so that, when the musical instrument's gain control is set to normal levels, at least some distortion (i.e., clipping) occurs. The musical instrument's gain control is adjusted to optimize the amount of distortion that occurs.

Accordingly, the amplifier strap 10 can be set to produce clean, yet amplified sound or distorted sound, as desired.

A first modification (see FIG. 2) to the amplifier strap 10 includes a belt clip 38 that is adapted to attach to a belt (not shown) or over an upper rim of a pair of pants. The belt clip 38 supports a remote battery 40. The remote battery 40 has more energy storage capability than the battery 26 and, accordingly, can drive a more powerful version of the amplifier circuit 22 and a first larger speaker 42, as is described in greater detail hereinafter. It can also last longer than the battery 26, which is useful for extended performances.

Also, when lower frequencies are amplified (i.e., bass sounds), a substantially greater amount of electrical energy is used than when mid range or high frequency sounds are amplified. This is because the human ear is especially sensitive to mid and high frequency sounds whereas a substantially greater energy level is required for bass frequencies. The remote battery 40 provides ample electrical energy for enhanced bass performance.

If desired, a remote amplifier circuit 44 is also attached to the belt clip 38. Of course, if desired, separate belt clips 38 could be provided, one for the remote battery 40 and another for the remote amplifier circuit 44. Additional belt clips 38 can also be provided to support additional remote batteries 40 that are wired in parallel or series, as desired, to further increase the capability of the amplifier strap 10.

A remote wire 46 is used to electrically connect the remote battery 40 to the amplifier circuit 22. Alternately, the remote wire 46 is used to electrically connect an output of the remote amplifier circuit 44 to the speaker 16 and an input of the remote amplifier circuit 44 to the second end 30*b* of the pickup wire 30.

Figure 3:
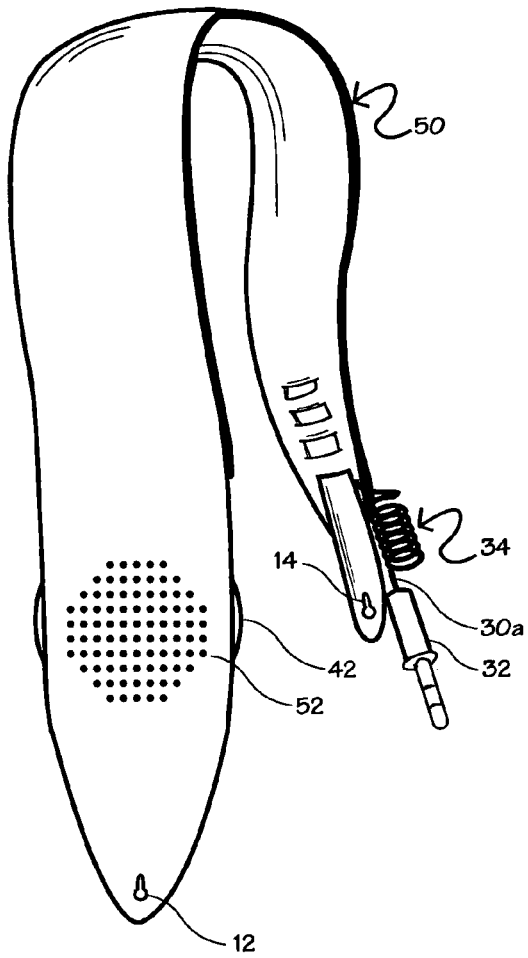
FIG. 3 is a view in perspective of a first modified amplifier strap.

Referring to FIG. 3 is shown a first modified strap 50 that is wider and includes the first larger diameter speaker 42. The first larger diameter speaker 42 includes a diameter of approximately three inches and a power handling capability of approximately one-half watt.

The first larger diameter speaker 42 has a lower frequency response capability than the speaker 16 and, therefore, delivers better bass and generally greater volume. The amplifier circuit 22 and battery 26 are sized to suit the first larger diameter speaker 42 or, alternatively, the remote battery 40 and/or remote amplifier circuit 44 are used with the first larger diameter speaker 42, as desired.

A plurality of larger openings 52 are disposed over the first larger diameter speaker 42 and are optimized in size, location, shape, and quantity to allow for optimum sound transmission through the larger openings 52.

The first larger diameter speaker 42 is useful whenever either a greater amplified volume is preferred, for example, when playing with other more powerful instruments or in noisy environments. It also provides cleaner, purer sound with less likelihood of distortion from clipping (i.e., overdriving the amplifier circuit 22 and the speaker 16) when the switch 53 is in the second on position.

It is also noted that certain musicians at certain times actually prefer the harmonic overtones that clipping can produce. Any version of the amplifier strap 10, 50, 100 can produce clipping, if desired, by setting the switch 53 to the third "distortion" position and by adjusting the gain on the musical instrument to a desired level. When the gain control on the musical instrument is set to a near-maximum level and the switch 53 is set to the third "distortion" position, then it is virtually assured that the amplifier circuit 22 will be overdriven and that at least some distortion will be heard.

Figure 4:
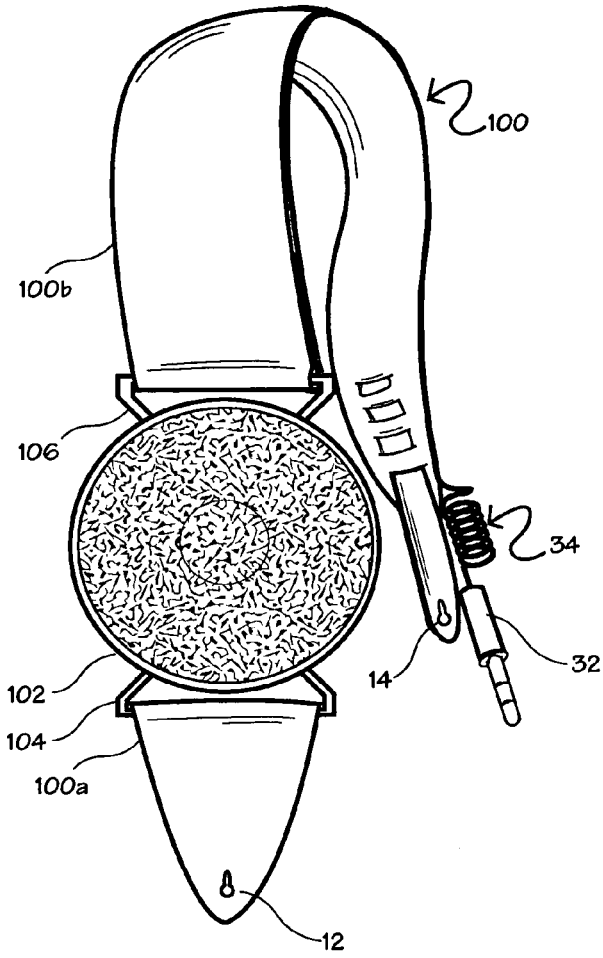
FIG. 4 is a view in perspective of a second modified amplifier strap.

Referring to FIG. 4 is shown a second modified strap 100 that is wider still and includes a second larger diameter speaker 102. The second larger diameter speaker 102 includes a diameter of approximately 4 and ½ inches and a power handling capability of approximately 2 and ½ watts.

The second larger diameter speaker 102 has a lower frequency response than the first larger diameter speaker 42 and, therefore, delivers even better bass, cleaner sound, and generally more volume. The amplifier circuit 22 and battery 26 are again sized to suit the second larger diameter speaker 102 or, alternatively, the remote battery 40 and/or remote amplifier circuit 44 are used with the second larger diameter speaker 102, as desired.

The second larger diameter speaker 102 is either open or it has a speaker cloth over its surface. The second larger diameter speaker 102 can be attached directly under the second modified strap 100 (not shown) similar to the speaker 16 and the first larger diameter speaker 42.

However, the second larger diameter speaker 102 preferably includes a pair of diametrically opposed brackets 104, 106. The second modified strap 100 is cut in half to produce a first half 100*a* and a second half 100*b*. An interior end of each half 100*a*, 100*b* is attached to one of the brackets 104, 106.

Both the first modified strap 50 and the second modified strap 100 provide the same benefits of easy set-up, no cords on the floor, etc., as the amplifier strap 10 while also providing increased levels of performance.

The second larger diameter speaker 102 is useful whenever either a still greater amplified volume is preferred, for example, when playing with other even more powerful instruments, or in especially noisy environments.

Any version of the amplifier strap 10, 50, 100 can include a housing (not shown) that is used to cover any of the component parts thereof, the housing being disposed on an inside of the strap 10, 50, 100 between the strap 10, 50, 100 and the body of the user.

Figure 5:
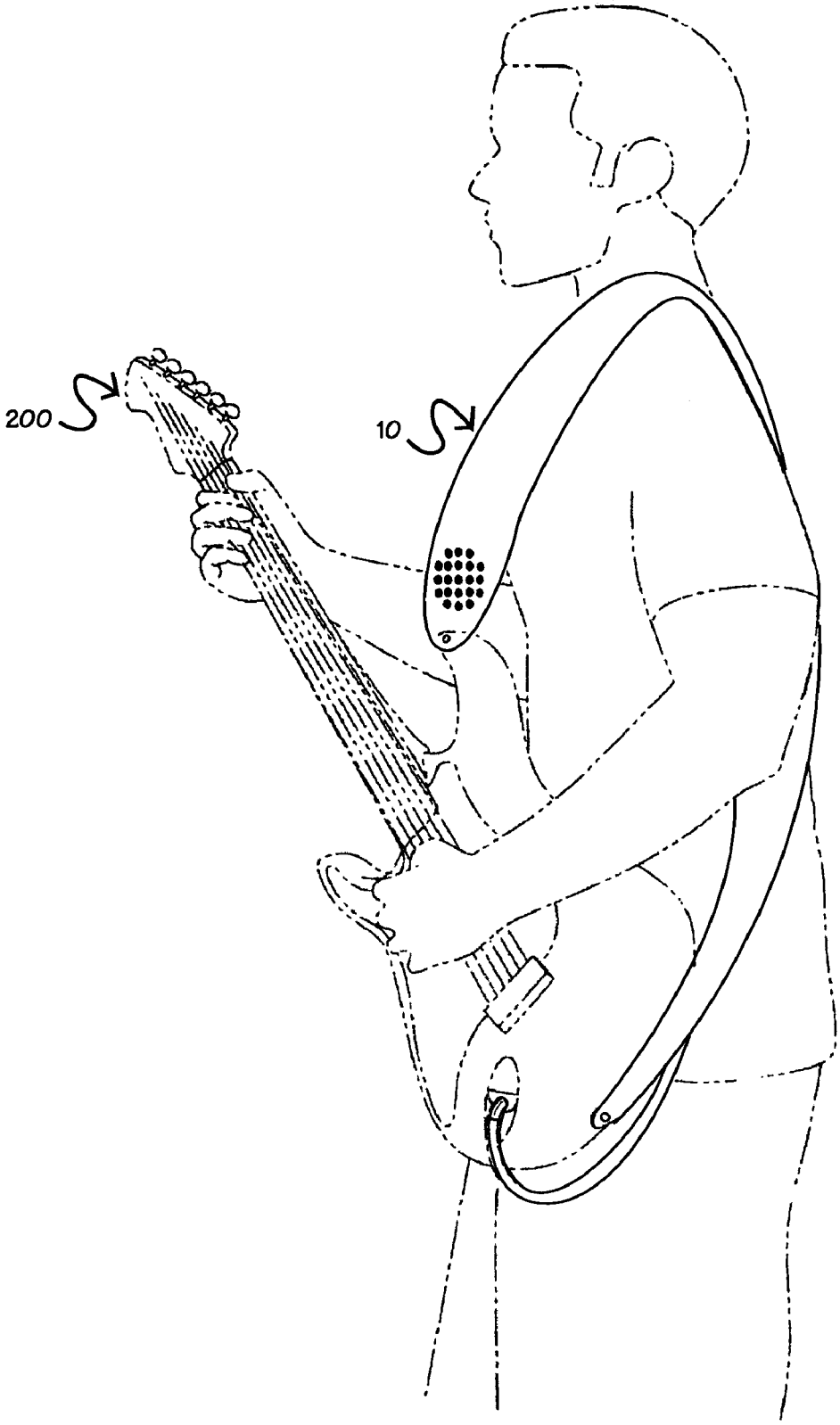
FIG. 5 is a view in perspective of the amplifier strap of FIG. 1 attached to a guitar.

Referring now in particular to FIG. 5 is shown the amplifier strap 10 attached to a guitar 200 as a preferred type of the musical instrument, ready for use.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

The invention claimed is:

1. An improved strap of the type adapted for use by a musician to support a stringed type of a musical instrument, wherein the improvement comprises:

a loudspeaker attached to said strap; including an amplifier circuit attached to said strap, an output of said amplifier circuit electrically connected to said speaker and including means adapted for supporting a battery by said musician at a location other that at said strap, and including means for electrically connecting said battery to said amplifier circuit.

2. The strap of claim 1 wherein said loudspeaker is permanently attached to said strap.

3. The strap of claim 1 wherein said loudspeaker is disposed to face away from said musician.

4. The strap of claim 1 including a battery attached to said strap, and including means for electrically connecting said battery to said amplifier circuit.

5. The strap of claim 1 including a pickup wire having a first end and an opposite second end, wherein said first end included means for connecting said first end to an electrical pickup of said musical instrument, and wherein said second end is electrically connected to an input of said amplifier circuit.

6. The strap of claim 5 wherein said means for connecting said first end includes an electrical connector.

7. The strap of claim 6 wherein said electrical connector includes a one-quarter inch male connector plug.

8. The strap of claim 5 including means for securing a portion of said pickup wire to said strap, wherein said portion is adapted to extend along a longitudinal length of said strap and wherein a remainder of said pickup wire extends away from said strap at a distal end of said strap with respect to said loudspeaker.

9. The strap of claim 5 wherein said pickup wire includes a coiled section disposed along a longitudinal length thereof, and wherein said coiled section is disposed proximate said first end of said pickup wire.

10. The strap of claim 1 wherein said strap includes a first portion and a separate second portion and wherein said first portion is attached at a first end thereof to said speaker and wherein an opposite end of said first portion is adapted to be attached to said musical instrument and wherein said second portion is attached at a first end thereof to said speaker at a location other than where said first portion is attached and wherein an opposite end of said second portion is adapted to be attached to said musical instrument at a location other than where said first portion is adapted to be attached.

11. An amplifier strap, said strap of the type adapted for use by a musician to support a stringed type of a musical instrument, comprising:

(a) a length of a material having a first end and an opposite second end, and including means for attaching said first end to said stringed instrument and said second end to said stringed instrument;

(b) a speaker attached to said strap; and (c) an amplifier circuit attached to said strap including means for electrically connecting an output of said amplifier circuit to said speaker and including means for supplying electrical power to said amplifier circuit.

12. The amplifier strap of claim 11 wherein said speaker is permanently attached to said strap.

13. The amplifier strap of claim 11 wherein said means for attaching said first end to said stringed instrument and said second end to said stringed instrument includes providing a first keyhole shaped opening in said strap at said first end and a second keyhole shaped opening in said strap at said second end, wherein said first keyhole shaped opening is adapted to be attached to a first location of said stringed instrument and wherein said second keyhole shaped opening is adapted to be attached to a second location of said stringed instrument.

* * * * *